US007108074B2

(12) United States Patent
Thomann et al.

(10) Patent No.: US 7,108,074 B2
(45) Date of Patent: Sep. 19, 2006

(54) DEVICE WITH A STORAGE TANK THAT IS FILLED OR CAN BE FILLED WITH AN ACTIVE INGREDIENT AND ATOMIZER UNIT

(75) Inventors: Jürg Thomann, Strengelbach (CH); Raphael Fleischhauer, Thunstetten (CH)

(73) Assignee: Piexon AG, Aarwangen (CH)

( * ) Notice: Subject to any disclaimer, the term of this patent is extended or adjusted under 35 U.S.C. 154(b) by 0 days.

(21) Appl. No.: 10/495,535

(22) PCT Filed: Nov. 14, 2002

(86) PCT No.: PCT/CH02/00610

§ 371 (c)(1),
(2), (4) Date: Jul. 29, 2004

(87) PCT Pub. No.: WO03/042623

PCT Pub. Date: May 22, 2003

(65) Prior Publication Data

US 2005/0040252 A1 Feb. 24, 2005

(30) Foreign Application Priority Data

Nov. 16, 2001 (EP) ..... 01811104

(51) Int. Cl.

| | |
|---|---|
| ***A62C 13/22*** | (2006.01) |
| ***A62C 13/00*** | (2006.01) |
| ***B05B 9/047*** | (2006.01) |
| ***B05B 11/02*** | (2006.01) |
| ***B05B 1/20*** | (2006.01) |

(52) U.S. Cl. ..... 169/84; 169/62; 169/72; 169/73; 169/33; 239/309; 239/322; 239/566

(58) Field of Classification Search ..... 169/84, 169/62, 72, 73, 33, 26, 28; 239/309, 322, 239/566, 320–321, 329; 222/386, 389; 42/1.08
See application file for complete search history.

(56) References Cited

U.S. PATENT DOCUMENTS 3,613,794 A * 10/1971 Naumann et al. ..... 169/28

(Continued)

FOREIGN PATENT DOCUMENTS

| | | |
|---|---|---|
| DE | 196 24 582 A1 | 1/1998 |
| GB | 937 023 A | 9/1963 |
| WO | WO 01/90674 A1 | 11/2001 |

*Primary Examiner*—David A. Scherbel
*Assistant Examiner*—Darren Gorman
(74) *Attorney, Agent, or Firm*—Birch, Stewart, Kolasch & Birch, LLP

(57) ABSTRACT

The apparatus (1*e*, 1*f*) according to the invention has a storage tank (5) which is or can be filled with an active substance (3), a pyrotechnic charge (6; 39) in a first end region (9) of the storage tank (5), a cartridge-case base (13) which can be driven by propellant gases of the fired charge (6; 39) in order to drive the active substance (3) out, and has a unit (7) for atomizing the active substance (3) being driven out, and at least one sensor (35*a*; 35*b*) which interacts with the charge (6; 39) in order to initiate the latter. The atomizer unit (7) is formed as an atomizer pipe (7) having a plurality of outlet nozzles (15) in the pipe casing in order to fill a spatial region (14) with a mist of the material of the active substance (3). One (18) of the ends of the atomizer pipe (7) is arranged in a second tank end region (19), facing away from the first and extending from the latter. The apparatus is distinguished by a compact and economical configuration with good automatic filling of a space with mist.

The apparatus can be used on its own or in a plurality in a parallel arrangement and also in a series arrangement for the protection of an object, be it firefighting or driving away unauthorized persons.

14 Claims, 5 Drawing Sheets

U.S. PATENT DOCUMENTS 3,773,111 A * 11/1973 Dunn ..... 169/26
3,897,828 A * 8/1975 Glover ..... 169/43
5,332,119 A 7/1994 Davis
5,556,003 A 9/1996 Johnson et al.
5,660,236 A 8/1997 Sears et al.
5,893,483 A 4/1999 Duran
5,899,277 A * 5/1999 Eisenbeiss et al. ..... 169/46
5,921,442 A 7/1999 Keller et al.
6,851,483 B1 * 2/2005 Olander et al. ..... 169/84
6,896,204 B1 * 5/2005 Greene et al. ..... 239/309

* cited by examiner

DEVICE WITH A STORAGE TANK THAT IS FILLED OR CAN BE FILLED WITH AN ACTIVE INGREDIENT AND ATOMIZER UNIT

TECHNICAL FIELD

The invention relates to an apparatus having a storage tank and atomizer unit for atomizing an active substance stored in the storage tank. The apparatus can be applied to a protection system or a fire extinguishing system.

PRIOR ART

In PCT/CH01/00319, a storage tank that is or can be filled with an active substance is described. The apparatus had a pyrotechnic charge in the first end region of the storage tank. In the storage tank there was a cartridge-case base which drove the active substance out of the storage tank through a nozzle by means of propellant gases produced when the charge was fired. The nozzle was arranged in an extension of the storage tank longitudinal axis. The apparatus was used mainly as a self-defence weapon but, in a modification, was also intended to be capable of use for automatic firefighting.

In the German laid-open specification DE-A 196 24 582, a liquid atomizer is described in which a liquid in a tank was driven out through a series of conical nozzles under high pressure by means of a pyrotechnically driven cartridge-case base (piston). The liquid used was an active substance such as pepper oil in order in the event of a break-in, for example to a large shopping area, to fill it with mist reliably and quickly. Here, too, the conical nozzle arrangement acted in the direction of an extension of the storage tank longitudinal axis.

In GB-A 937 023, a three-part storage unit to be used as a flamethrower or fire extinguisher is described. The unit had a U-shaped tank with an outlet nozzle screwed on to one of the two limb ends. The direction of flow of the active substance out of the nozzle was in the limb longitudinal axial direction. A replaceable gas generating tank was screwed to the other U-limb end. This U-limb was only partly filled with active liquid in such a way that a clearance remained with respect to the limb. The liquid was closed off with respect to the clearance by an elastic ball or other elements acting in an analogous manner.

In U.S. Pat. No. 5,660,236, a firefighting apparatus is described. This apparatus had a storage tank that was or could be filled with an active substance (3). The active substance could be driven out with a cartridge-case base on the storage tank top moved by means of a pyrotechnic charge. Spatial atomization was carried out around the storage tank top, in whose jacket radial wall passages were arranged for this purpose.

SUMMARY OF THE INVENTION

Object

It is an object of the invention to provide a compact, economical apparatus with which a spatial region can automatically be filled with mist.

Depending on the active substance to be atomized, the apparatus can be used for the purpose of keeping unauthorized persons, such as burglars, vandals, and so on away from an object or of protecting the object against fire by using a fire prevention agent.

If the apparatus is used for protection of an object against burglars, vandals, etc., then an irritant liquid or an irritant gas can be used as the storage tank charge (active substance); however, it is also possible for powdered substances to be used. In the case of powdered substances, however, guide elements have to be provided in order that its guidance around bends is also ensured.

The liquid active substances used can, for example, be the substances listed below:

A capsaicin solution is already currently used in the known "pepper sprays". Capsaicin is an extract from the chilli pepper plant, which is normally dissolved in alcohol with a concentration between 1% and 4%. Capsaicin leads to sudden, temporary inflammation of all mucous membranes with which it comes into contact (for example eyes, respiratory passages). Capsaicin acts both in humans and in animals. As opposed to the lachrymator listed below, it leads to involuntary closure of the eyes.

A further liquid charge (active substance) that can be used is a CS solution. CS is a lachrymator which stimulates tears. As an additional effect, intense itching is produced on the skin. CS acts only in humans.

It is also possible for CN solutions to be used. CN leads to nausea. However, it acts more slowly than a CS or capsaicin solution.

It is also possible for stinking secretions to be used as liquid charges. Most stinking secretions additionally lead to nausea.

CS and CN can also be used in gaseous form instead of a liquid charge.

As a solid charge (active substance) for self-defence, it is also possible, for example, for capsaicin to be used, which in its pure form is crystalline at room temperature. However, solutions act more quickly than applied solid, then powdered charges. However, powdering charges have the advantage that they remain over a certain time period in the room as a cloud.

It is also possible for mixtures of liquid and gaseous substances to be used as charges. These are then often foams which remain adhering to the attacker to be repulsed. Here, too, capsaicin can be used.

Mixtures of solid and liquid active substances likewise often contain capsaicin. These are, for example, gels. It is also possible for dyestuffs to be used for the subsequent identification or marking of a perpetrator.

The apparatus is particularly well suited for fire prevention in closed rooms, for example in an engine or freight compartment. Here, water can be used as an active substance. Then, a dense water mist, which consists of extremely small water droplets (aerosol), is expelled from the nozzles of the atomizer pipe of the apparatus under high pressure in a few fractions of a second. This water mist is propagated very quickly in the burning engine or freight compartment and extinguishes the fire firstly by withdrawing oxygen (suffocation) and secondly by cooling the source of the fire. In this case, the fine water droplets form a very large surface and in this way extract a great deal of thermal energy from the fire, which cools the source of the fire quickly. About 1.5 $m^3$ of water vapour are produced from one litre of water. Since the water mist is expelled into the limited engine or freight compartment at very high pressure, the atomizer nozzles do not need to be aimed directly at the source of the fire. The water vapour produced by the heat of the fire is propagated very quickly in the sealed compartment and extinguishes the fire indirectly. In order to prevent the risk of subsequent fire, the installation can have a second arrangement of apparatuses.

As opposed to known sprinkler systems, the apparatus according to the invention or a system having a plurality of these apparatuses is no longer connected to an extinguishing agent pipe network. The extinguishing agent is located in the apparatus with a predefined volume. In addition, a sprinkler system only has the network pressure available, on the other hand the apparatus according to the invention has a pyrotechnic charge which builds up a gas pressure in order to drive out the extinguisher and in a manner of an explosion following firing, so that the discharge can take place in about 20 ms. Since the apparatus according to the invention is independent of a pipe network, it can be used irrespective of location, such as in vehicles, containers, drums, dispatch cases, and so on. In addition, as a result of the atomization units described below, the result is significantly better production of mist in a compartment than in the case of the conventional sprinkler systems.

Achievement

The above problems of conventional sprinkler systems are solved by various aspects of the disclosed embodiments.

The apparatus according to the invention has a storage tank which is or can be filled with an active substance and also a pyrotechnic charge in a first end region of the storage tank. Furthermore, the apparatus has a cartridge-case base for driving the active substance out of the tank. The cartridge-case base can be moved by the propellant gases of the fired charge towards the end of the tank, which is not identical with the position of the nozzles. The nozzles are arranged in an atomizer unit arranged in the tank end region in such a way that the stream of active substance which can be set moving by the cartridge-case base is deflected in the second tank end region and is then transferred into the atomizer pipe. Furthermore, the apparatus has at least one detonator, preferably a sensor which is used to initiate the pyrotechnic charge. The detonator is chosen on the basis of the conditions of use of the apparatus. By means of the configuration described here, filling a spatial region with mist is no longer restricted to the storage tank top end region. The spatial region to be filled with mist can now be selected freely.

If the apparatus is to be used for firefighting, then the detonator used is what is known as a fire detector, which responds to temperature or smoke. If the apparatus is to be used to protect an object against burglars, vandals and so on, the detonator is a vibration sensor, proximity sensor, glass breakage sensor, and so on. In both cases, non-automatic triggering can also be carried out. In this case, for example, a television monitoring system can be provided. The observer, who then detects the break-in via a television image, will then perform manual triggering via a "firing switch" as detonator.

As opposed to the nozzle arrangement of the prior art cited above, the apparatus according to the invention now has an atomizer pipe with a plurality of outlet nozzles in the pipe casing. Spraying the active substance in the direction of an attacker, opponent, and so on is now no longer carried out. Instead, filling a spatial region with mist is now performed. One of the ends of the atomizer pipe is arranged at a second tank end region, facing away from the first, and extends from the latter. The course of the atomizer pipe can thus be made in such a way that optimum filling of the space with mist is provided.

The outlet nozzles will preferably be formed in such a way that the active substance does not emerge in extension of the storage tank longitudinal axis. In the prior art, the emergence of active substance was always performed in such a way that, in the case of a normally elongated storage tank, the said emergence took place on its top side. Here, on the other hand, in particular the emergence of active substance on the top side is avoided. The intention is even preferably, in the case of a plurality of outlet nozzles, to arrange these in particular at a distance from the top side. This is because it has proven to be advantageous, if a spatial region is to be filled well with mist, to arrange the outlet nozzles over a longitudinal region. In the case of use against an opponent, it may be advantageous to aim the active substance towards the latter. In the case of an automatically operating apparatus, where the location of the opponent or fire is not known, it is advantageous to fill a spatial region with mist. The outlet nozzles have therefore deliberately not been placed in the immediate vicinity of the second tank end region (top side).

The apparatus will preferably no longer be used on its own but in arrangements of a plurality of apparatuses. In one preferred design variant, the apparatuses are now configured in such a way that they are constructed modularly, such that they can be laid without difficulty in a "parallel circuit" and also in a series circuit.

A series circuit has the advantage that, by using only a single detonator (sensor), a number of apparatuses can be "fired" one after another. This results in a relatively economical arrangement since, as a rule, the sensor is the most complicated and therefore most expensive element in the arrangement. The serial arrangement (cascade series) of the apparatuses is recommended, for example, in a fire suppression arrangement in freight compartments of an articulated goods vehicle. The apparatuses would preferably be fitted to the freight compartment roof. Depending on the amount of extinguishing agent needed, one to several cascade series will be installed per freight compartment or per trailer. The expenditure for making electrical contact from the sensor is very low, since in each case it has to be carried out only at one end of the cascade.

Wherever a great deal of space is not available for the installation and where, for example, part spaces separated from one another are to be filled with mist, such as in engine compartments, the parallel arrangement of the apparatuses (extinguishing modules) may be indicated. The individual apparatuses are installed separately from one another and contact is made separately with a "firing cable" from the sensor. However, on the other hand, the high flexibility in the parallel installation necessitates higher expenditure for the electrical connection to the sensor or sensors.

Irrespective of whether apparatuses are used in parallel or in series operation, they all have an identical storage tank, an identical cartridge-case base and, if an analogous space is to be filled with mist, an identical atomizer pipe.

In the case of apparatuses for parallel operation, there is only one single type of charge that can be fired electrically. Each storage tank is closed with a storage tank closure cap.

In the case of apparatuses for series operation, only a first storage tank has a charge that can be fired electrically. The closure of this storage tank is removed, however, and in its place a coupling piece is fitted, to which a second storage tank can be flange-mounted. This second storage tank then has no charge that can be fired electrically but a charge that can be fired mechanically and which is fired by an impact of the cartridge-case base of the first apparatus. A third apparatus, and so on, can then be flange-mounted to the second apparatus. The second and each further apparatus in an arrangement of this type are in each case fired by the kinetic energy of the cartridge-case base of the apparatus connected upstream.

In order to simplify the modularity of the apparatus for a cascade or parallel application, both the first and the second tank end regions have a thread, onto which both a holding cap for a pyrotechnic charge, in particular an electro-pyrotechnic charge, and a coupling piece for coupling a first tank end region of a further storage tank can be screwed. It is then possible to form the two threads identically. However, it is also possible to use different threads, use then preferably being made of identical pitches but a right-hand and a left-hand thread being provided, in order that, when the coupling piece is screwed on, the adjacent apparatuses are drawn against each other.

Since a spatial region is to be filled with mist, the storage tank will be formed so as to be elongated, in particular with a circularly cylindrical cross section, and the atomizer pipe will be arranged to run along the storage tank casing. The atomizer pipe can then run as a "bow" outside the storage tank. However, the storage tank can also be "sheathed" with an outer pipe, which then bears the outlet nozzles in its casing.

If the atomizer pipe is formed as a "bow", the storage tank has a connector with a first flange projecting laterally in each case in the first and in the second tank end region, and the "bow pipe" in each case has a second flange matching the first flanges at its pipe ends. Preferably, between the flanges located adjacent to the second tank end region (top side) of the storage tank and of the atomizer pipe, a dividing means is arranged which, in the unfired state of the charge, prevents the active substance penetrating into the atomizer pipe and, when the charge is fired, breaking as a result of the build-up of pressure in the active substance, allows the active substance into the atomizer pipe to be expelled through the nozzles of the latter.

Further advantageous embodiments and feature combinations of the invention emerge from the following detailed description and all of the patent claims.

BRIEF DESCRIPTION OF THE DRAWINGS

In the drawings used to explain the exemplary embodiments.

In principle, identical parts are provided with identical reference symbols in the figures.

PREFERRED EMBODIMENTS OF THE INVENTION

Figure 1:
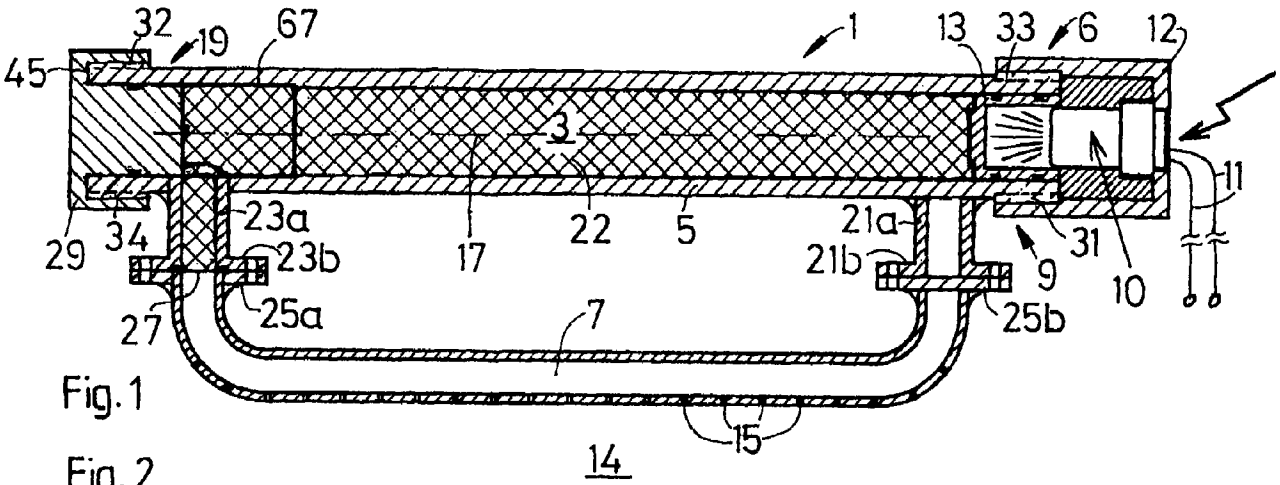
FIG. 1 shows a longitudinal section through an apparatus according to the invention.

The apparatus 1 according to the invention illustrated in FIG. 1 has a storage tank 5 filled with an active substance 3, a pyrotechnic charge 6 which can be fired electrically, and an atomizer pipe 7 as a unit for atomizing the active substance 3. The storage tank 5 is formed here, by way of example, as a pipe with a circularly cylindrical cross section. The charge 6 is arranged in a first end region 9 of the storage tank 5. The charge 6 is formed as a pyrotechnic gas generator 10 which can be fired electrically and is held in a retaining cap 12 screwed onto the end region 9. The gas generator 10 is fired via the two cables 11. Also present is a cartridge-case base 13, which is driven into the storage tank 6 against the active substance 3 away from the charge 6 by the gases produced by the firing.

Figure 2:
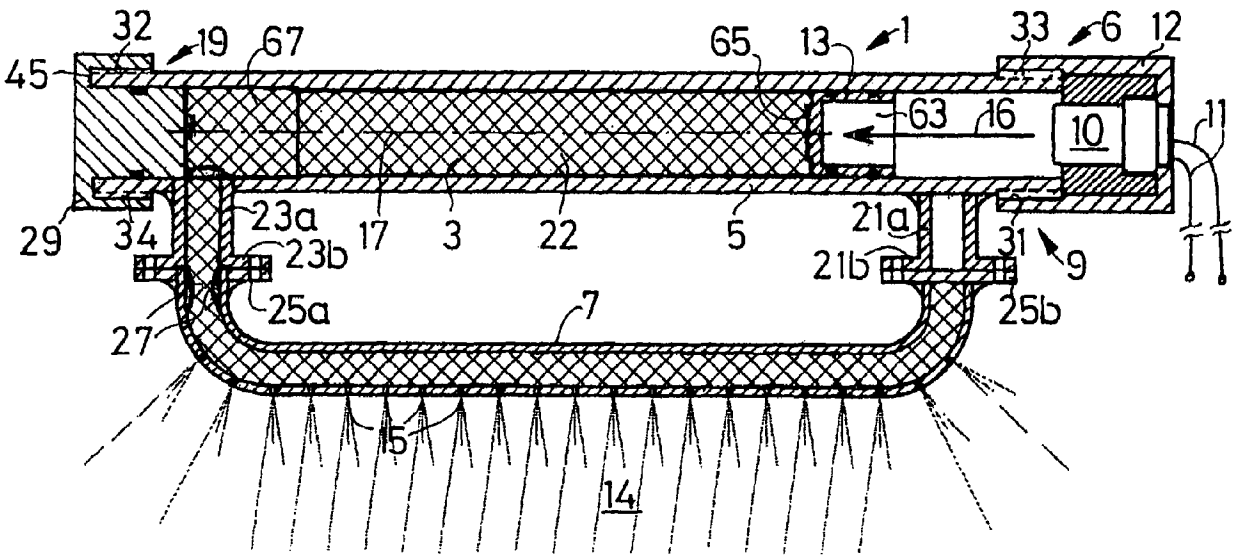
FIG. 2 shows a longitudinal section analogous to the illustration in FIG. 1, the charge of the apparatus having just been fired here.

By means of the pressure of the gas acting on the active substance 3, the active substance 3 is pressed into the atomizer pipe 7, deflecting the stream of active substance, and, through its outlet nozzles 15 arranged in the casing, forming a mist, is pressed out into an adjacent spatial region 14. This process is indicated in FIG. 2, the movement of the cartridge-case base 13 being indicated by the arrow 16. Only as a result of the deflection of the stream of active substance, which is avoided in particular in the prior art, and an appropriate arrangement of the outlet nozzles, is a specific selection of the spatial region envisaged to be filled with mist possible.

The outlet nozzles 15 are arranged in a row here, by way of example. The nozzle outlets are aimed away from the longitudinal axis 5 of the storage tank 5.

One of the ends of the atomizer pipe 7 is arranged in a second tank end region 19, facing away from the first 9, in such a way that it extends from the said second tank end region 19. The outlet nozzles 15 are formed in such a way that the active substance does not emerge in extension of the storage tank longitudinal axis 17. The outlet nozzles 15 are not located in the immediate vicinity of the second tank end 19 either.

The apparatus 1 illustrated in FIGS. 1 and 2 has, in the first storage tank end region 9, a blind connector 21*a* with a flanged connection 21*b*. The blind connector 21*a* has no connection to the interior 22 of the storage tank; it merely has a retaining task. In the second storage tank end region 19, which is opposite the first storage end region 9, there is a further connector 23*a*, likewise with a connecting flange 23*b*. The two connectors 21*a* and 23*a* point in the same direction and run parallel to each other. The connector 23*a* opens into the interior 22 of the storage tank. The atomizer pipe 7 is formed in the manner of a bow and has two connecting flanges 25*a* and 25*b* matching the connecting flanges 21*b* and 23*b*. The flanges 23*b* and 25*a* are screwed to each other in a fluid-tight manner by means of a sealing element (for example an O ring). Between the flanges 23*b* and 25*a*, what is known as a bursting disc 27 is clamped in at the edge, preventing the active substance 3 penetrating into the atomizer pipe 7. This bursting disc 27 can also be used for sealing instead of the sealing element. Only when the charge 6 has been fired does the bursting disc 27 burst as a result of the build-up of pressure in the active substance 3 because of the cartridge-case base 13. Since the bursting disc 27 is clamped in firmly at its edges between the flanges 23*b* and 25*a*, it remains in place even in the burst state. No disc parts are torn off, which means that no blockage of the outlet nozzles 15 is possible.

The second end region 19 is closed by a tank closure cap 29. Both the first and the second tank end regions 9 and 19 have an identical external thread 31 and 32, respectively. The charge 6 and the tank closure cap 29 have likewise identical internal threads 33 and 34, respectively, matching the threads 31 and 32. The advantage which results from this will be explained below.

Figure 3:
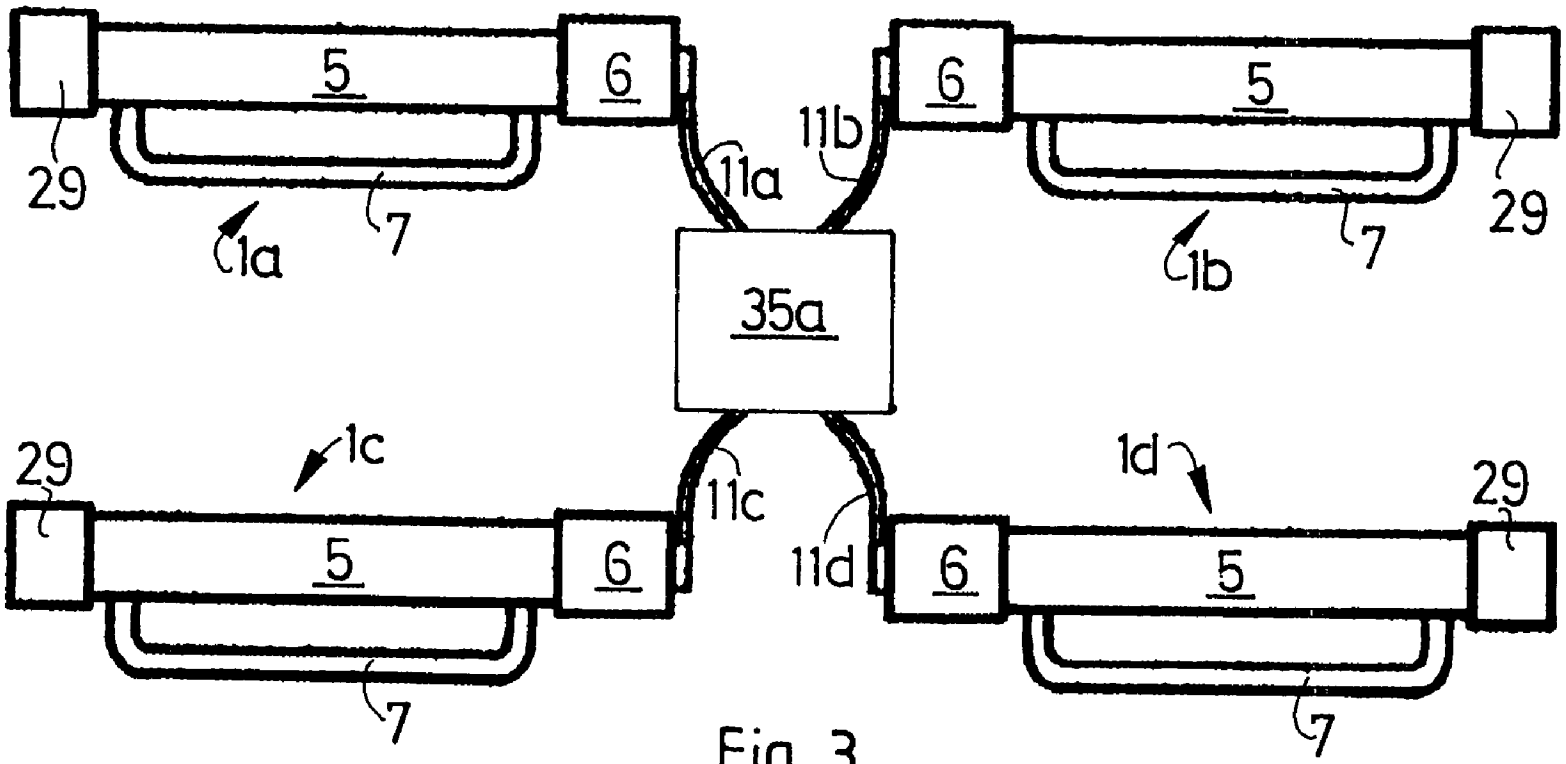
FIG. 3 shows a system having four apparatuses in a parallel circuit.

It is, then possible for an apparatus 1 to be used on its own or for a plurality of apparatuses to be used together as a system, as already mentioned above. FIG. 3 shows a parallel circuit of four apparatuses 1*a*–1*d*, which are connected electrically to a sensor 35 as a detonator via cables 11*a*–11*d*. Instead of the sensor 35, use can also be made of only one firing switch. If the system is to be used to protect an object against vandalism, burglary or other violent acts, the sensor 35*a* used is, for example, a proximity sensor, glass breakage sensor, vibration sensor and so on. The apparatuses are then filled with an appropriate active substance, as mentioned at the beginning. It is not necessary for all the apparatuses 1*a*–1*d* to be filled with one and the same active substance; it is also possible for different fillings to be used, depending on the desired action.

If the system is to be used for fire prevention, the apparatuses 1*a*–1*d* will be filled with water, $CO_2$ or another extinguishing agent.

Figure 4:
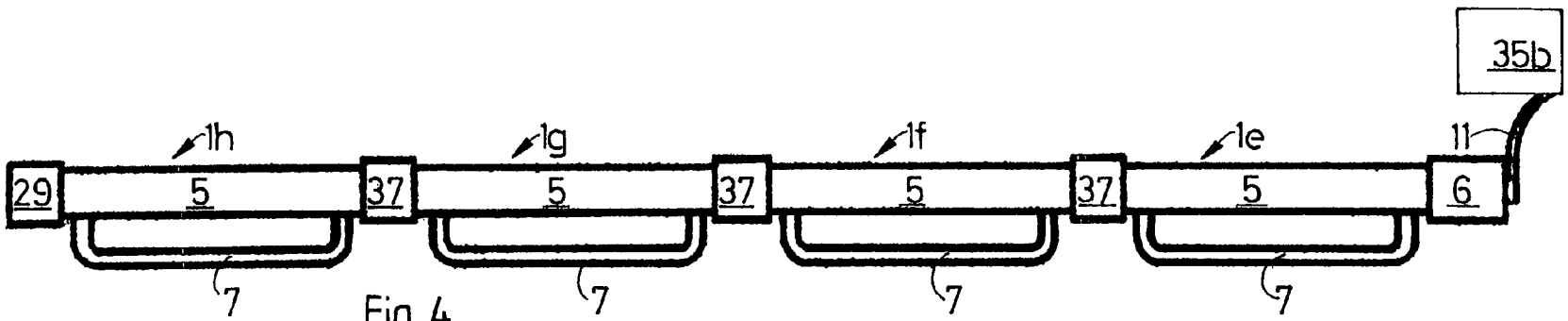
FIG. 4 shows a system having four apparatuses in a cascade (series) circuit.

Instead of a parallel circuit, as illustrated in FIG. 3, it is also possible for four apparatuses 1*e*–1*h* to be arranged together in a row as a series or cascade series, now with only a single sensor 35*b*, as illustrated in FIG. 4.

The apparatuses to be used in a cascade arrangement differ only slightly from those which are used in a parallel circuit. Since the apparatuses are constructed modularly, the apparatuses can be converted from one to the other with regard to a parallel or cascade arrangement in a simple way.

Figure 5:
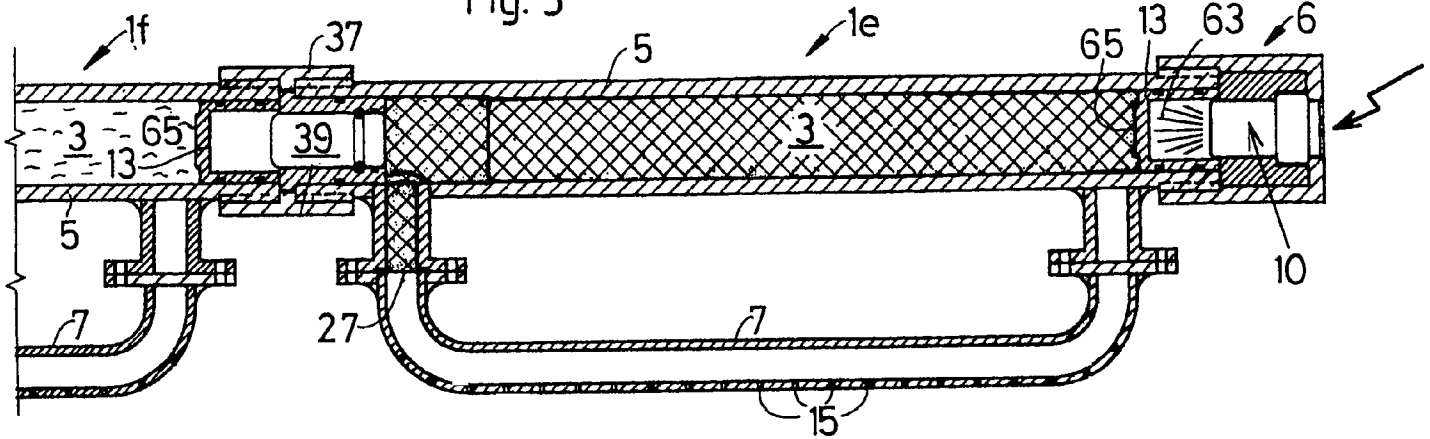
FIG. 5 shows a longitudinal section through two apparatuses arranged one after another in a cascade circuit.

FIG. 5 shows a cascade arrangement of two apparatuses 1*e* and 1*f* arranged one after another. The apparatus 1*e* largely corresponds to the apparatus illustrated in FIGS. 1 and 2. Therefore, identical elements are also identified by identical reference symbols. In order to connect the two apparatuses 1*e* and 1*f*, only the tank closure cap 29 is replaced by a coupling piece 37 and a pyrotechnic charge 39, which can be fired by means of a mechanical impact of the cartridge-case base 13 of the apparatus 1*e*.

Figure 6:
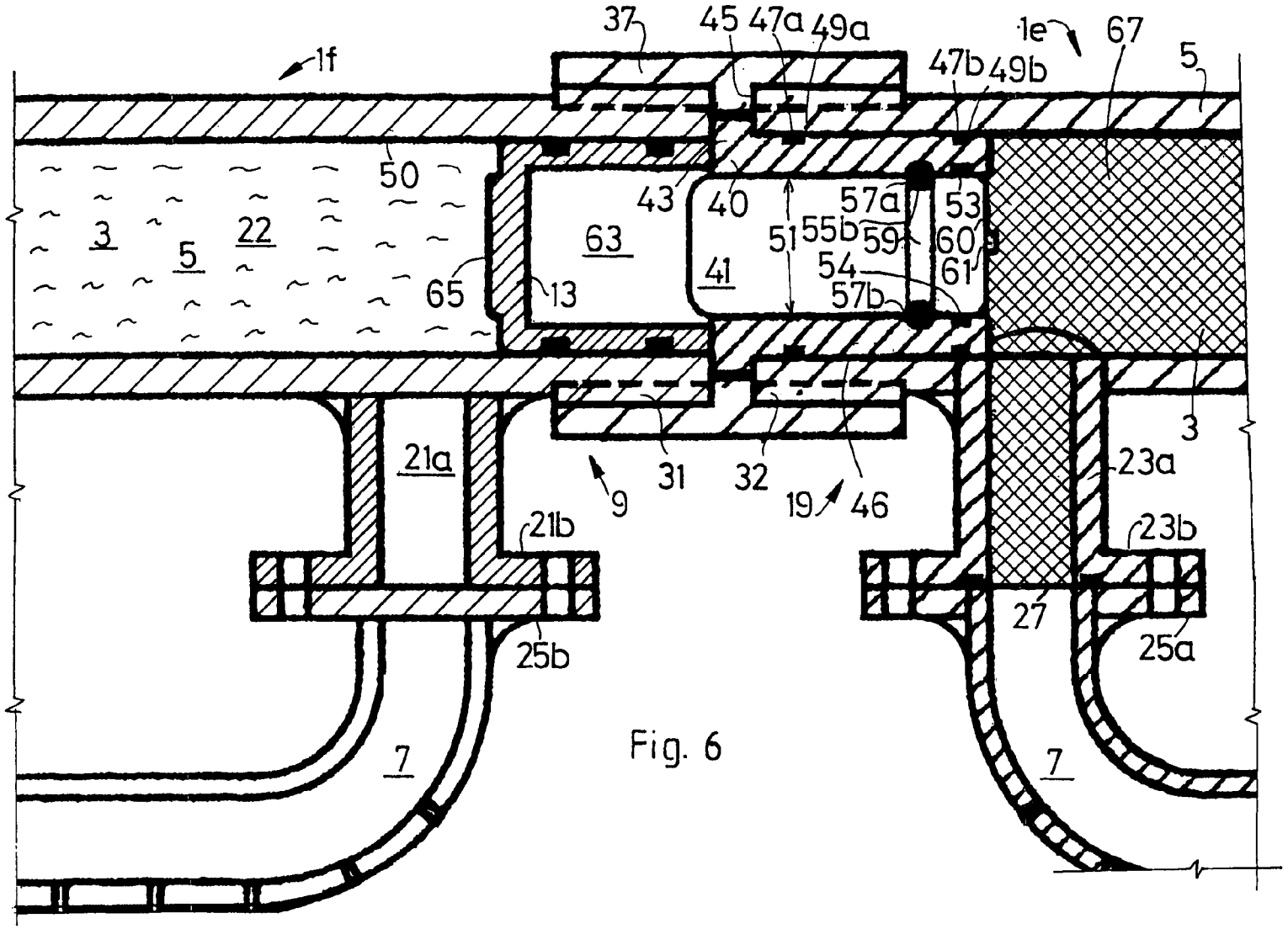
FIG. 6 shows a detail enlargement of the connection, shown in FIG. 5, of the two apparatuses to each other.

As can be seen in the detail enlargement of the connection of the two apparatuses 1*e* and 1*f* in FIG. 6, the charge 39 comprises a retaining element 40 in which a gas generator 41 that can be fired mechanically is held. The retaining element 40 is formed with a circularly cylindrical cross section and, in the second end region 19, can be inserted into the interior 22 of the apparatus 1*e* until an annular terminating edge 43 bears on the end face 45 of the end region 19. The outer casing 46 of the retaining element 40 is sealed off in a fluid-tight manner with respect to the inner surface 50 of the interior 22 by two sealing rings 47*a* and 47, which lie in grooves 49*a* and 49*b* in the outer casing 46. The retaining element 40 has a central internal bore 51 which, in its end region facing away from the edge 43, has a groove 53 for a sealing ring 54. The retaining element 40 also has two "secant bores" 55*a* and 55*b* running parallel to each other. The secant bores 55*a* and 55*b* run from the outer casing 46 to the internal bore 51, approximately tangentially past the inner surface of the latter, to the outer casing 46 again. A carrier pin 57*a* and 57*b* is pushed through each of the secant bores 55*a* and 55*b* and then engages on the gas generator 41, in the external groove 59 of the latter, in order to hold the latter in the retaining element 40. The gas generator 41 likewise has a circularly cylindrical cross section. On its end 60 projecting into the interior 22 of the apparatus 1*e*, it has a striker pin 61.

Figure 7:
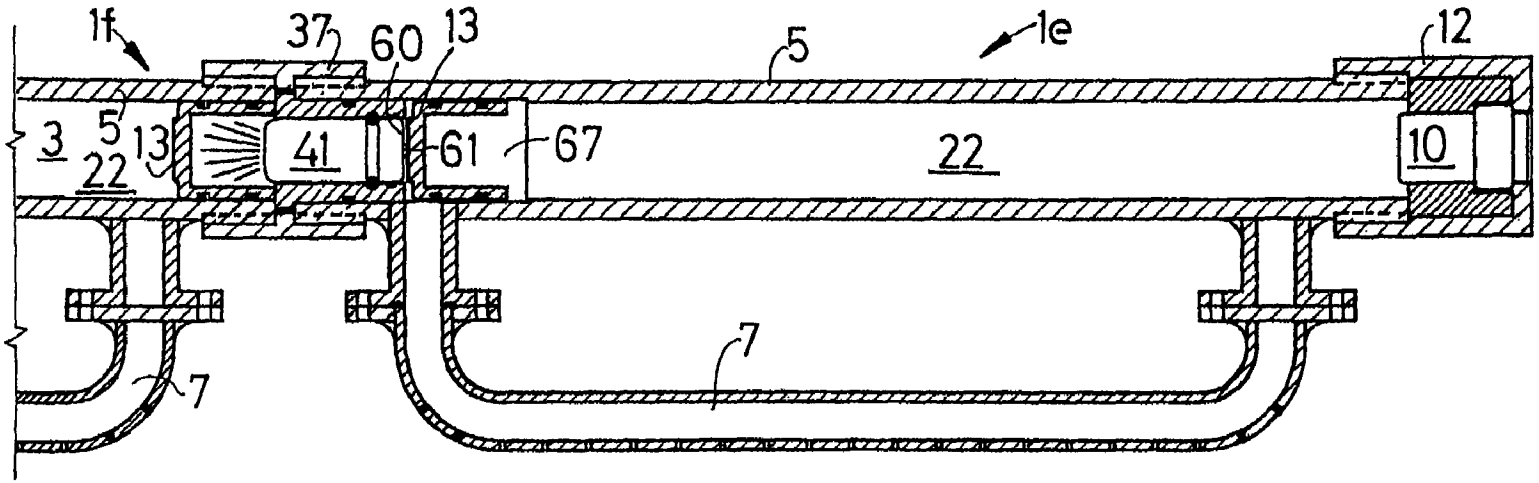
FIG. 7 shows a cross section analogous to the illustration in FIG. 5, here the active substance of the first apparatus being driven out and the cartridge-case base of this apparatus just firing the charge of the following apparatus arranged in series.

If the pyrotechnic gas generator 10 of the charge 6 of the apparatus 1*e* is fired electrically via a signal from the sensor 35*b*, then it sends gas into the interior 63 of the cartridge-case base 13 in the manner of an explosion, as a result of which the latter is driven in the manner of a shot in the direction of the arrow 16 by the gas generator 10. The bursting disc 27 bursts, active substance 3 shoots into the atomizer pipe 7 and emerges from the outlet nozzles 15, forming a mist. Once virtually all the active substance 3 has been driven out, the end face 65 of the cartridge-case base 13 strikes the striker pin 61 of the gas generator 41 of the charge 39 of the apparatus 1*f*, as a result of which the latter is fired and gas enters the interior 63 of the cartridge-case base 13 of the apparatus 1*f* in the manner of an explosion (see FIG. 7). This cartridge-case base 13 is then forced in the manner of a shot against the active substance 3 of the device 1*f*, as a result of which this active substance is driven out in a manner analogous to that of the apparatus 1*e*. This process is repeated until the active substance of the last apparatus, here the apparatus 1*h*, has been driven out. The apparatus 1*h* then has the tank closure cap 29 illustrated in FIGS. 1 and 3 as an end.

In order that no residual pressure from the gas generators remains in the apparatuses, a pressure relief means can be provided, as described in PCT/CH01/00319 and illustrated in particular in FIG. 3 there.

However, here a relief region 67, which is located in front of the second end region 19, contains the connector 23*a* and belongs to the storage tank 5, is provided with an internal diameter which is larger than the external diameter of the cartridge-case base 13. In addition, the axial length of this relief region 67 is greater by a tolerance than that of the cartridge-case base 13. Then, if the cartridge-case base 13 reaches this relief region 67, driving the active substance 3 out, the propellant gas can flow into the atomizer pipe 7 between its outer wall and the inner wall of the region 67 and can emerge through the outlet nozzles 15 for the purpose of complete pressure relief.

The "secant bores" do not have to run in parallel; they can form any desired angle with each other. Nor is it necessary for two secant bores and two carrier pins to be present; it is also possible for more to be provided. A clamping ring can also be used for retention, which then snaps into the groove 59. However, because of its simple production and assembly, the embodiment described above has been tried and tested.

The atomizer pipe 7 is described as a tubular bow above. A design of this type is advantageous in a rugged embodiment of the apparatus. However, other shapes can also be made. As already mentioned above, the atomizer pipe can also be formed as a casing pipe around the storage tank 5. However, the atomizer pipe can also be formed as a projecting pipe which is fixed only to the end region 19. The atomizer pipe does not have to have a circular cross section; any desired cross sections, such as in the form of a square tube, an elliptical tube and so on, are possible. If a projecting pipe is chosen, then this does not have to project in a straight line; it can be curved as desired.

In addition, the storage tank 5 does not necessarily have to have a circularly cylindrical cross section. The storage interior merely has to be formed in such a way that a cartridge-case base can be moved in order to drive the active substance out. This means that elliptical and polygonal cross sections are possible, while adapting the shape of the cartridge-case base.

In order to connect the two apparatuses 1*e* and 1*f*, as mentioned above, it is merely necessary for the tank closure cap 29 to be replaced by a connecting piece 37 and a pyrotechnical charge 39, the coupling piece 37 and the outer end region of the storage tank 5 being formed in such a way that a screw fixing would be possible. Instead of this screw fixing, however, a flange connection analogous to the elements 25*a* and 23*b* can also be selected. Of course, other types of connection can also be selected.

The invention claimed is:

1. Apparatus comprising:

a storage tank which is or can be filled with an active substance, said storage tank having a first end region in the vicinity of one end of the storage tank and a second end region in the vicinity of the opposite end of the storage tank;

a pyrotechnic charge that can be initiated by an initiator in the first end region of the storage tank;

a cartridge-case base which can be driven by propellant gases of the fired charge in order to drive the active substance out; and an atomizing unit for atomizing the active substance being driven out, wherein the atomizing unit includes an atomizer pipe having outlet nozzles formed within the pipe casing in order to fill a spatial region with a mist of the active substance, one of the ends of the atomizer pipe being connected in the second end region of the storage tank, such that the active substance can be moved by movement of the cartridge-case base from the first end region to the second end region and transferred into the atomizer pipe, and such that the active substance undergoes a diversion and, based on the corresponding arrangement of the atomizer pipe having outlet nozzles, is atomized into a chosen spatial region.

2. Apparatus according to claim 1, wherein the storage tank has a longitudinal axis, the atomizer pipe extends from the second tank end region of the storage tank, and the outlet nozzles are formed in such a way that the active substance does not flow in the direction of the storage tank longitudinal axis.

3. Apparatus according to claim 1 wherein the charge, storage tank and atomizer pipe are formed as a kit of elements in such a way that a plurality of apparatuses can be arranged in parallel for parallel operation, by an initiator acting on a plurality of charges and in such a way that a plurality of apparatuses can be arranged in cascade series for series operation and an electrical contacting from the initiator is to be made only on one end of the cascade.

4. Apparatus according to claim 1 wherein the storage tank is elongated and the atomizer pipe is arranged to run along the storage tank casing.

5. Apparatus according to claim 1, wherein the storage tank has a flange at the second end region, the atomizer pipe is bent in the manner of a bow and, at one end of its pipe ends, has a second flange that matches the first flange and a bursting device is arranged which, in the unfired state of the charge, prevents the active substance from penetrating into the atomizer pipe and, when the charge is fired, breaking as a result of the build-up of pressure in the active substance, allows the active substance into the atomizer pipe to be expelled through the nozzles of the latter.

6. Apparatus according to claim 2, wherein the outlet nozzles are not located in the immediate vicinity of the second end region of the storage tank.

7. Apparatus according to claim 3, wherein each storage tank has a tank closure cap in its second end region, that the tank closure cap is formed by a coupling piece for coupling to the first tank end region of a further storage tank, and that in the coupling piece the pyrotechnic charge which can be fired by means of an impact of the cartridge-base case of the preceding apparatus.

8. Apparatus according to claim 7, wherein both the first and the second tank end region have such a coupling formation capable of serving both as a retaining cap for a pyrotechnic gas generator of the charge and also as a coupling piece for coupling the first tank end region of a further storage tank.

9. Apparatus according to claim 8, wherein the coupling formation is a thread.

10. Apparatus according to claim 8, wherein the pyrotechnic gas generator is an electro-pyrotechnic gas generator.

11. Apparatus according to claim 1, wherein the storage tank has a circularly cylindrical cross section.

12. Apparatus according to claim 5, wherein the bursting device is arranged between the flanges of the storage tank and of the atomizer pipe located adjacent to the second end region of the storage tank.

13. A protection system, having at least one apparatus according to one of claims 1–3, 4, 5, 6–12, for protecting an object, the initiator is formed as a breakage sensor, vibration sensor and/or contact sensor, in order to keep unauthorized persons (burglars, vandals and so on) off or away from an object to be protected.

14. A fire extinguisher system, having at least one apparatus according to one of claims 1–3, 4, 5, 6–12, without any connection to an extinguishing agent pipeline, wherein the initiator is as a fire detector and the active substance is an extinguishing agent.

* * * * *